US005504470A

United States Patent [19]

Ginn

[11] Patent Number: 5,504,470

[45] Date of Patent: Apr. 2, 1996

[54] RESISTOR TRIMMING PROCESS FOR HIGH VOLTAGE SURGE SURVIVAL

[75] Inventor: Steven N. Ginn, Granger, Ind.

[73] Assignee: CTS Corporation, Elkhart, Ind.

[21] Appl. No.: 135,043

[22] Filed: Oct. 12, 1993

[51] Int. Cl.[6] ..... H01C 7/10; H01C 10/10

[52] U.S. Cl. ..... 338/20; 338/21; 338/195; 338/260; 338/320; 219/121.69

[58] Field of Search ..... 338/20, 21, 195; 219/121.69, 121.68, 121.71

[56] References Cited

U.S. PATENT DOCUMENTS 1,771,236 7/1930 Schellenger .
2,041,213 5/1936 Schellenger et al. .
2,068,113 1/1937 Schellenger et al. .
3,304,199 2/1967 Faber et al. .
4,403,133 9/1983 Turner et al. ..... 219/121.69
4,528,546 7/1985 Paoli .
4,563,564 1/1986 Ericsen et al. ..... 219/121.69
5,043,694 8/1991 Higashi et al. ..... 338/195

*Primary Examiner*—Marvin M. Lateef
*Attorney, Agent, or Firm*—Albert W. Watkins

[57] ABSTRACT

Several trim patterns are illustrated which are suited for use in high voltage, surge prone environments. The invention combines a block resistor with a simple scan cut and two or more plunge cuts to simply form a resistor. The resulting resistor is immune to adverse affects associated with current crowding and arcing, both known to have much adverse impact on the prior art.

3 Claims, 3 Drawing Sheets

RESISTOR TRIMMING PROCESS FOR HIGH VOLTAGE SURGE SURVIVAL

BACKGROUND OF THE INVENTION

1. Field of the Invention

This invention pertains to the field of electrical resistors generally, and specifically to processes used to alter or adjust the value of such resistors.

2. Description of the Related Art

As with any technology, electrical resistors have evolved in many different ways. Materials, processes and applications have all varied and usually improved with time. The processes used to produce electrical resistors have, but for a few very expensive operations, been limited to relatively low cost, rapid operations.

Early methods for production of resistors involved the application of various forms of carbon such as lampblack or graphite to suitable substrates. Exemplary of these early resistors are U.S. Pat. Nos. 1,771,236, 2,041,213 and 2,068,113 assigned to the assignee of the present invention. Since the materials were of low cost and applied via difficult to control methods such as brushing or spraying, the resistance values varied from resistor element to resistor element. As illustrated in the U.S. Pat. No. 1,771,236 patent, resistance values were adjusted using scraping blades which were hand manipulated.

The need for higher reliability and higher operating temperatures in a small, low cost package fueled the development of newer, more robust materials. Exemplary of these materials is the ruthenium cermet materials illustrated in U.S. Pat. No. 3,304,199, also assigned to the assignee of the present invention. This material, a ruthenium based material pioneered by the assignee and adopted worldwide as the industry standard yet today, offers a very high temperature material capable of surviving great extremes of power, temperature and environment.

Part of the ruggedness of the ruthenium based material comes from the combination of ceramics, glasses and metals that make up the composition. It is generally referred to as a Cermet, from contracting the words CERamic and METal. This material can be customized to resistance values ranging from a fraction of an ohm to many megohms, while only requiring a very tiny space upon a substrate.

The new cermet materials revolutionized the electronics industry and opened up applications never before possible. Unfortunately, these materials, like their predecessors, are not precisely reproducible to exact resistance values. Some variation is introduced when the materials are applied (usually by screen printing). Variation may also be introduced during manufacture and during the very high temperature firing processes used to form the finished resistors.

In order to adjust these newer electrical resistors to a final, more exact value, excess material is typically applied. Then, after all variable processes are completed, excess material is trimmed, or removed, from the resistor. In the prior art, this very rugged material is removed with such equipment as specially hardened milling and routering bits, sand blast equipment, and, of more recent fame, laser equipment. Even chemical methods such as acid etching have been considered. Regardless of the equipment used for removal, the end goal is the same. Removal of the right amount of material to leave a resistor of the desired value is the objective.

Further refinement of the trimming processes has led to at least a limited understanding of the events and consequences associated with each removal method. As this understanding has progressed, there have been a number of attempts at defining a better trim pattern to use for removal of the right amount of resistor material. Exemplary of these efforts are U.S. Pat. Nos. 4,403,133 and 5,043,694. In these patents, lasers equipped with modern controllers are used to remove complex patterns of material from resistors. The patterns used are difficult to generate without expensive equipment, and the calculations necessitated by these patterns are difficult. Further, the precision required limits those inventions to computer controlled laser trimming equipment.

One particularly demanding application for electrical resistors is in circuits or environments where large electrical surges may be applied to the electrical resistor. Survival of the resistor during these surges demands a high quality component free from defects that might lead to destructive failure. U.S. Pat. No. 4,528,546 discusses this concern in some detail, but offers a solution of only limited utility.

Prior art FIGS. 1 to 3 are used to illustrate this in detail. Each figure illustrates a simple block type resistor, similar to that illustrated in U.S. Pat. No. 4,528,546. Each of the figures then illustrates a different type of laser trim cut known in the prior art. Electrical terminals are formed and shown as 1 and 2, and may be formed as taught in U.S. Pat. No. 4,528,546, incorporated herein by reference. Typically, this is accomplished by screen printing a conductive composition upon a ceramic substrate, the substrate which is not illustrated in these figures for simplicity sake. A resistor 3 is then formed to interconnect terminals 1 and 2.

FIG. 1 illustrates a simple plunge cut 10 into resistor 3. A controller (not shown) is used to measure the resistance between terminals 1 and 2, and this measured value is then compared with a desired value. The end of the plunge cut, illustrated as point 12, may be computed and then the cut made. However, for precise resistors, the cut is normally made while the resistance is being monitored. When the resistance reaches a desired value, the laser is turned off, so that no further removal of resistor material occurs.

While this method of trimming is fairly simple, a very large voltage gradient will exist across the trim region. The gradient is a result of the redirection of current which occurs as a direct result of the trim. From FIG. 1, looking at lines of current flow 4, it is apparent that the current crowds into the region surrounding point 12. That region will heat very unevenly, and may destructively fail. Additionally, the voltage gradient that exists during a surge condition may cause arcing to occur across the trim line 10 in an area indicated by arrows 5. Such arcing will also lead to destruction of the resistor.

A better type of cut is illustrated in FIG. 2, where the effects of current crowding are reduced somewhat. However, calculations for making the cut are more difficult, and the cut is more time consuming. In addition, the risk of destructive arcing still exists near points 5.

FIG. 3 illustrates a scan cut 36 combined with a plunge cut 30. Here, current flow 4 runs parallel to the scan cut 36, and no localized current crowding exists. This cut is simpler to calculate, since the resistance need only be initially measured and compared with the desired value and the current width. The desired width is then directly calculated and the trim made at the appropriate location. Plunge cut 30 prevents current from flowing through resistor segments 7 and 9. Unfortunately, the full voltage developed between terminals 1 and 2 will be present across cut 30, and will relatively easily arc across from points 5.

SUMMARY OF THE INVENTION

The present invention seeks to overcome the limitations of the prior art by combining a scan cut with a number of plunge cuts, also sometimes referred to as a comb cut. The use of the comb cut alleviates the issue of arcing due to excessive voltage gradient, while the scan cut offers much simplicity in the formation thereof and also prevents destructive failure caused by current crowding induced localized heating. The cuts may be formed on many different types of prior art resistor devices using a variety of prior art methods for material removal. The resultant pattern offers much performance improvement over the prior art in demanding applications such as high power, high voltage, surge-prone environments.

DESCRIPTION OF THE PREFERRED EMBODIMENT

Figure 4:
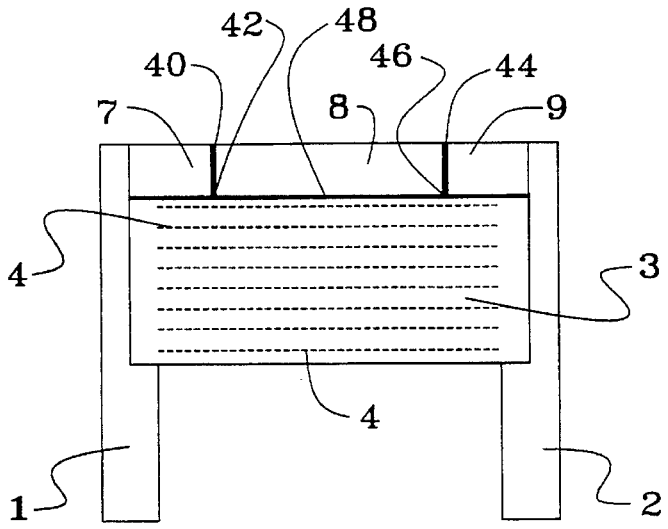
FIG. 4 illustrates diagrammatically a first embodiment of the invention.

FIG. 4 illustrates a first embodiment of the invention. Illustrated therein is a block resistor 3 having electrical terminations 1 and 2. As with the remaining figures, it is understood that these terminations 1 and 2, together with resistor 3, will typically be formed as thick film materials upon a substrate, though there is no requirement thereof.

Figure 1:
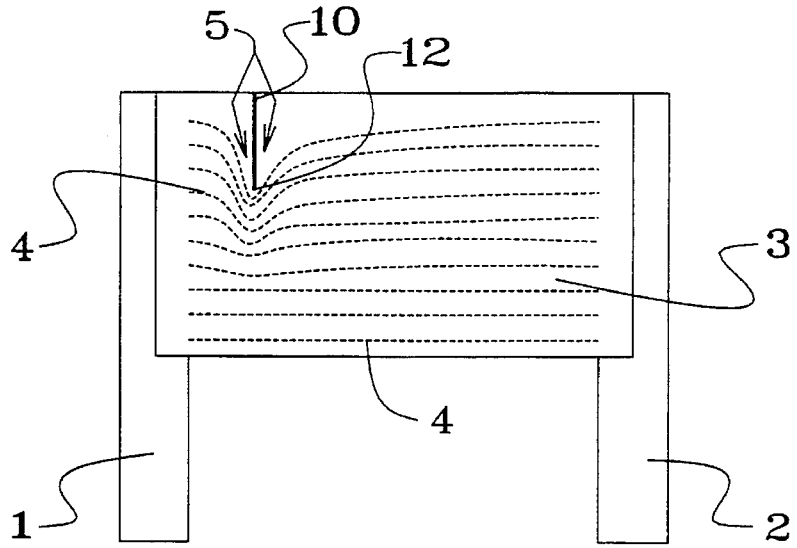
Figure 1 (Prior Art)
FIGS. 1–3 are prior art figures illustrating diagrammatically several different trim patterns used on block type resistors.
Figure 2:
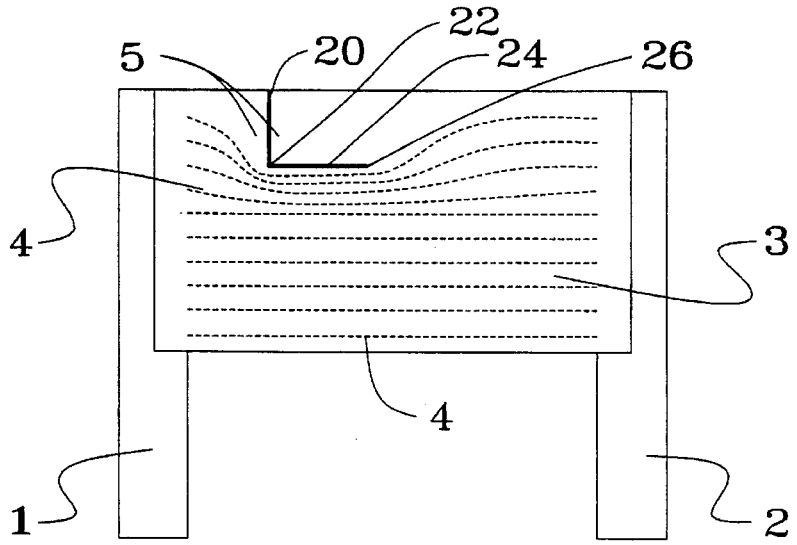
Figure 2 (Prior Art)

There is a scan cut 48 extending between terminals 1 and 2 which begins to define resistor segments 7, 8 and 9 from the remainder of block resistor 3. Additionally, there are two extra wide plunge cuts 40 and 44 that electrically isolate resistor segment 8 from segments 7 and 9. Plunge cuts 40 and 44 extend from the edge of any resistor material 3 to points 42 and 46 respectively. Points 42 and 46 are preferably selected to be assured of extending into scan cut 48, in spite of any tolerance that may exist. Ideally, points 42 and 46 do not extend beyond scan cut 48. If they did, the resistance value will change and these extensions might suffer from drawbacks symptomatic of the plunge cut shown in prior art FIG. 1.

Figure 3:
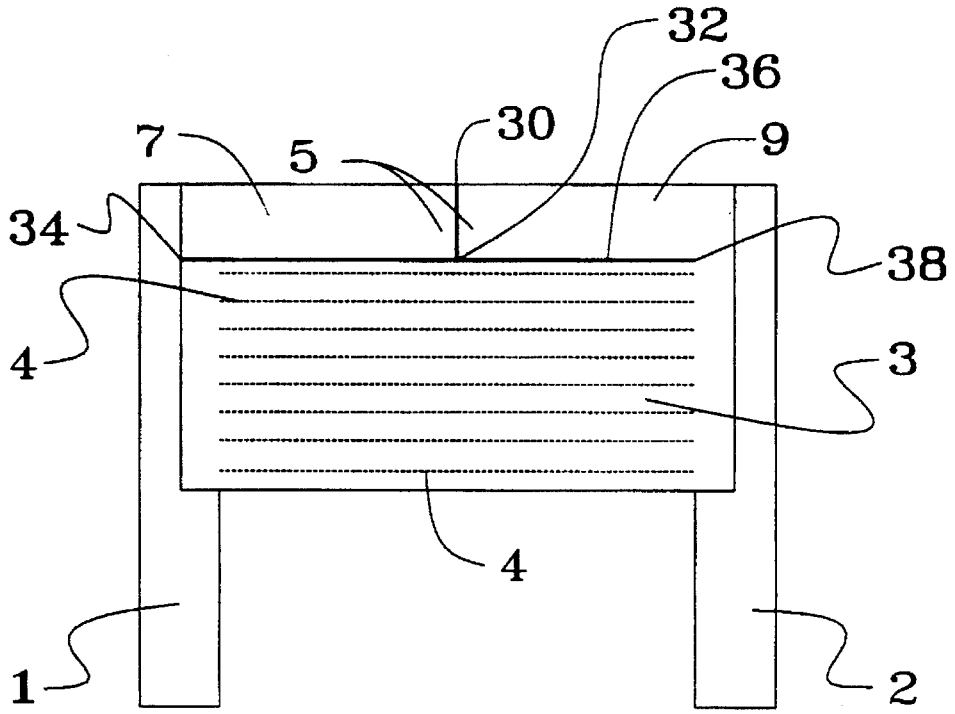
Figure 3 (Prior art)

The resistor element 3 of FIG. 4 has parallel lines of current flow 4 extending between terminals 1 and 2, similar to prior art FIG. 3. However, the additional plunge cut serves to provide added protection against arcing that might otherwise occur. This arcing would in most cases be prevented strictly by the isolation provided by a single plunge cut. However, the inventor observes that potentials induced in resistor segments such as segment 8 may rise to levels which approximate the full levels applied across terminals 1 and 2. The use of an extra plunge, combined with widening of these plunges provides some assistance. When using a laser trimming station to form the extra width plunge cuts 40 and 44, the beam may be defocussed, or, more typically, several excursions between the edge of the resistor material and scan cut 48 are made to successively widen the region of laser ablated material.

Figure 5:
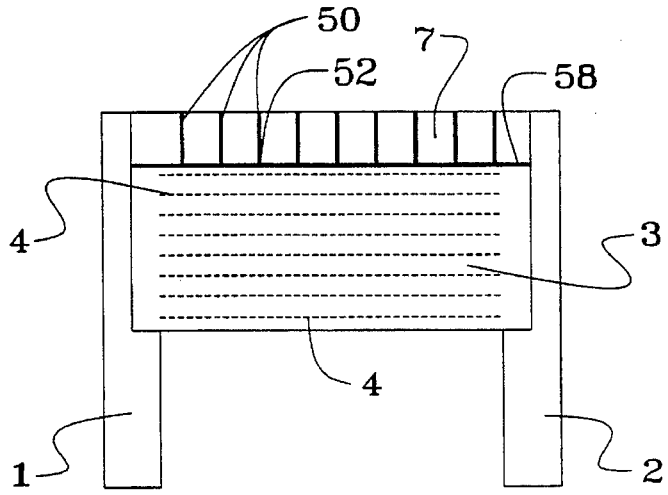
FIG. 5 illustrates diagrammatically the preferred embodiment of the invention.

FIG. 5 illustrates the preferred embodiment of the invention. Therein are a number of plunge cuts 50, which are also commonly referred to as a comb cut due to their appearance similar to that of the teeth on a comb. Similar to the plunge cuts 40 and 44 of FIG. 4, these comb cuts terminate at points 52 which correspond with scan cut 58. This leaves a number of resistor segments 7 which advantageously are small in size and many in number. Several advantages are gained. First, the duplication of cuts improves manufacturing yield and device reliability. Particle contaminants sometimes associated with various manufacturing processes will not induce arcing due to the multiplicity of the gaps provided by the comb cut. Additionally, segments 7 are of small size relative to resistor block 3, and any voltages that may be induced are of proportionately smaller magnitude. This design requires no more laser time than the pattern of FIG. 4, while this design is able to withstand the highest voltages and currents.

The process used to trim a resistor according to the preferred embodiment begins with a measurement of the initial resistance. A film resistor has a resistance value which is simply calculated based upon the number of ohms per square of resistor, where a square is one unit of equal length and width. Therefore, decreasing the effective width of a resistor to one half the original will exactly double the number of squares and will therefore double the final resistance.

The next step after measuring the initial resistance and calculating the width reduction required is to make the scan cut (58 as shown in FIG. 5). Then a single plunge cut is made and the resulting resistance is measured again and compared with the desired value. Additional scan cuts may be made to fine tune the resistance, though in practice it has been found that a second cut is rarely necessary to achieve accuracies within a few percent. This is because the geometry of the trimmed resistor is so simple (a plain rectangle) that the calculated location of the first cut is very accurate.

The remaining vertical cuts are then made. These final comb cuts do not affect the overall resistance but rather function to improve the ability to withstand high or surge voltages.

While the foregoing details what is felt to be the preferred embodiment of the invention, no material limitations to the scope of the claimed invention is intended. Further, features and design alternatives that would be obvious to one of ordinary skill in the art are considered to be incorporated herein. For example, one of ordinary skill in the art will observe that the geometries illustrated herein are applicable to a wide variety of resistor materials and to many different trimming methods. While cermet materials and laser trimming form part of the preferred embodiment, it will be apparent that carbon and other known materials would be trimmable to the same pattern. Further, trimming methods could include sand blasting, milling, routering, etching and other known techniques. In fact, owing to the simplicity of the cut lines, there is little limitation at all on the trimming method. The scope of the invention is set forth and particularly described in the claims hereinbelow.

I claim:

1. A resistor capable of withstanding high surges of current and voltage comprising:

an electrically insulating support;

a first electrical termination and a second electrical termination, said electrical terminations parallel to each other;

electrical resistor material physically between and electrically less conductive than said electrical terminations, said electrical resistor material physically supported by said insulating support and divided into a main body region and three segments;

said main body region being electrically continuous from said first electrical termination to said second electrical termination and having a first edge perpendicular to and extending entirely between said electrical terminations;

said three segments of resistor material being electrically disconnected and being physically adjacent to said first edge of said main body and between said first and said second electrical terminations.

2. A method of making a high voltage surge resistor including two terminations through which an electric current may be caused to flow, comprising the steps of:

measuring an initial resistance value of said resistor;

calculating an amount of resistor material necessary to remove to achieve a desired resistance value;

cutting a scan line along a line perpendicular to said terminations of said surge resistor and completely therebetween, so as to fully electrically disconnect a first region of resistor material from a second region other than through said terminations;

cutting a first plunge line parallel to said terminations and therebetween from a first edge of said resistor material to said scan line, thereby forming three distinct segments of resistor material;

measuring a resulting resistance value of said resistor between said terminations;

cutting an additional plunge line parallel to said first plunge line and displaced therefrom, said additional plunge line extending from said first edge of said resistor material to said scan line, thereby forming four distinct segments of resistor material.

3. The method of claim 2 further comprising:

making a second scan cut perpendicular to said terminations when said measured resulting resistance value of said resistor does not equal said desired resistance value.

* * * * *